US011473542B2

(12) United States Patent
Vermeeren et al.

(10) Patent No.: US 11,473,542 B2
(45) Date of Patent: Oct. 18, 2022

(54) BRACKET AND METHOD FOR CLAMPING AN INJECTOR ONTO A CYLINDER HEAD

(71) Applicant: DAF Trucks N.V., Eindhoven (NL)

(72) Inventors: Joost Petrus Johannes Vermeeren, Beek en Donk (NL); Bert Van Nijlen, Retie (BE)

(73) Assignee: DAF Trucks, N.V., Eindhoven (NL)

( * ) Notice: Subject to any disclaimer, the term of this patent is extended or adjusted under 35 U.S.C. 154(b) by 0 days.

(21) Appl. No.: 17/694,809

(22) Filed: Mar. 15, 2022

(65) Prior Publication Data

US 2022/0298998 A1 Sep. 22, 2022

(30) Foreign Application Priority Data

Mar. 18, 2021 (NL) ..... 2027770

(51) Int. Cl.
*F02M 61/14* (2006.01)
*F02M 61/16* (2006.01)

(52) U.S. Cl.
CPC ..... *F02M 61/14* (2013.01); *F02M 61/168* (2013.01); *F02M 2200/85* (2013.01); *F02M 2200/852* (2013.01); *F02M 2200/855* (2013.01)

(58) Field of Classification Search
CPC .. F02M 61/14; F02M 61/168; F02M 2200/85; F02M 2200/852; F02M 2200/855
USPC ..... 123/470
See application file for complete search history.

(56) References Cited

U.S. PATENT DOCUMENTS 4,206,725 A * 6/1980 Jenkel ..... F02M 61/14 123/470
5,794,595 A * 8/1998 Berger ..... F02F 7/006 123/470
6,116,218 A * 9/2000 Sato ..... F02F 1/242 123/470
6,431,152 B1 * 8/2002 Estacio ..... F02M 61/14 123/470

(Continued)

FOREIGN PATENT DOCUMENTS

DE 102011088293 A1 6/2013
DE 202015103512 U1 10/2015

OTHER PUBLICATIONS

Dutch Search Report and Written Opinion—App No. 2027770—dated Nov. 15, 2021.

*Primary Examiner* — Erick R Solis
(74) *Attorney, Agent, or Firm* — Banner & Witcoff, Ltd.

(57) ABSTRACT

A bracket for clamping an injector onto a cylinder head of an internal combustion engine, comprising a clamp section, arranged for providing a clamping force onto the injector to clamp the injector onto the cylinder head; a mount section, extending from the clamp section and arranged for mounting the bracket to the cylinder head adjacent the injector; and a support section, extending from the mount section opposite the clamp section and arranged for supporting the bracket onto the cylinder head at a lever distance from the clamp section, to define the clamping force; wherein the support section comprises a plurality of support elements, each of said support elements arranged at a different lever distance, such that a selected support element from the plurality of support elements engages, in use, with the cylinder head at a selected lever distance, such that the bracket is supported on the selected support element only, to control a magnitude of the clamping force.

9 Claims, 5 Drawing Sheets

(56) References Cited

U.S. PATENT DOCUMENTS

| | | | | |
|---|---|---|---|---|
| 6,769,409 | B2 * | 8/2004 | Evancik | F02M 61/14 123/470 |
| 6,786,204 | B2 * | 9/2004 | Heinrich | F02M 61/14 123/470 |
| 6,928,987 | B2 * | 8/2005 | Nakamura | F02M 61/14 123/470 |
| 7,735,474 | B2 * | 6/2010 | Hardy | F02M 61/14 123/470 |
| 2010/0300408 | A1 | 12/2010 | Aronhalt et al. | |

* cited by examiner

BRACKET AND METHOD FOR CLAMPING AN INJECTOR ONTO A CYLINDER HEAD

CROSS-REFERENCE TO RELATED APPLICATIONS

This application claims priority under 35 U.S.C. § 119 to Application NL 2027770, filed Mar. 18, 2021, which is hereby incorporated by reference in its entirety.

FIELD OF THE INVENTION

The invention relates to a bracket and method for clamping an injector onto a cylinder head of an internal combustion engine.

BACKGROUND OF THE INVENTION

When mounting a fuel injector onto a cylinder head of an internal combustion engine, the injector is clamped by a bracket that is designed to provide a specific clamping force, in accordance with the design characteristics of the engine, in particular the cylinders and cylinder pressures that may occur therein. When mounting the bracket on the cylinder head, the bracket holds the injector positioned and well aligned during operation of the internal combustion engine. Misalignment of the fuel injector with respect to the cylinder head may reduce performance, or worse, cause damage to the internal combustion engine or parts thereof. As such, the coupling between the injector and the cylinder head should take into account e.g. cylinder pressures and other forces pertaining to specific configurations of internal combustion engines.

In trucks, injectors are typically clamped to a cylinder head by a specifically designed bracket, for ease of assembly and maintenance. Clearly, for different motor designs, this amounts to different bracket designs, which adds to the production cost. In the prior art, efforts have been undertaken such as in CN102562396 and KR20020085007, that address a problem of having various space constraints around an internal combustion engine. To this end a bracket is proposed for clamping an injector having a groove for linearly positioning the bracket relative to its support points, so that the bracket can be flexibly adjusted in space.

However, these solutions typically use brackets that only take into account a single engine configuration, as the bracket design is optimized for providing a clamping force that opposes a specific set of engine related forces and pressures.

It remains a challenge to design a bracket that can be flexibly adjusted in clamping force, such that it is suitable for multiple configurations of internal combustion engines, without changing the design or specification of the bracket.

SUMMARY OF THE INVENTION

In one aspect, embodiments of the invention pertain to a bracket for clamping an injector onto a cylinder head of an internal combustion engine. The bracket comprises a clamp section, a mount section, and a support section. The clamp section is arranged for providing a clamping force onto the injector to clamp the injector onto the cylinder head.

The mount section extends from the clamp section and is arranged for mounting the bracket to the cylinder head adjacent the injector. The support section extends from the mount section opposite the clamp section and is arranged for supporting the bracket onto the cylinder head at a lever distance from the clamp section, to define the clamping force.

The support section comprises a plurality of support elements. Each of said support elements is arranged at a different lever distance, such that a selected support element from the plurality of support elements engages, in use, with the cylinder head at a selected lever distance, such that the bracket is supported on the selected support element only, to control a magnitude of the clamping force.

Another aspect of the invention pertains to a method of clamping an injector onto a cylinder head of an internal combustion engine by the bracket. The method comprises selecting, from a plurality of support elements arranged for supporting the bracket onto the cylinder head at different lever distances from a clamp section of the bracket, a support element at a selected lever distance to control a magnitude of a clamping force. The method further comprises modifying the cylinder head, such that the selected support element from the plurality of support element engages, in use, with the cylinder head at the selected lever distance such that the bracket is supported on the selected support element only. Next, the method comprises mounting the bracket to the cylinder head between the selected support element and the injector, to provide the clamping force onto the injector to clamp the injector onto the cylinder head.

By having a bracket comprising multiple support points, a constant, e.g. predefined, preload force can be used to transfer multiple clamp loads to an injector without changing the bracket design. Accordingly, the bracket design and specification can be used for multiple types of injectors and engine heads, within a broad range of clamping requirements. Combined with having a uniformly prescriptible preload force, that is the same irrespective of a selected support element, this may facilitate manufacturing and assembly processes, as well as maintenance, and quality and inspection processes, since operators do not have to specify the preload force in the process but any rely on a prescribed fixed preload force irrespective of the clamp load.

BRIEF DESCRIPTION OF THE DRAWINGS

The invention will be further elucidated in the figures.

DETAILED DESCRIPTION

Figure 1:
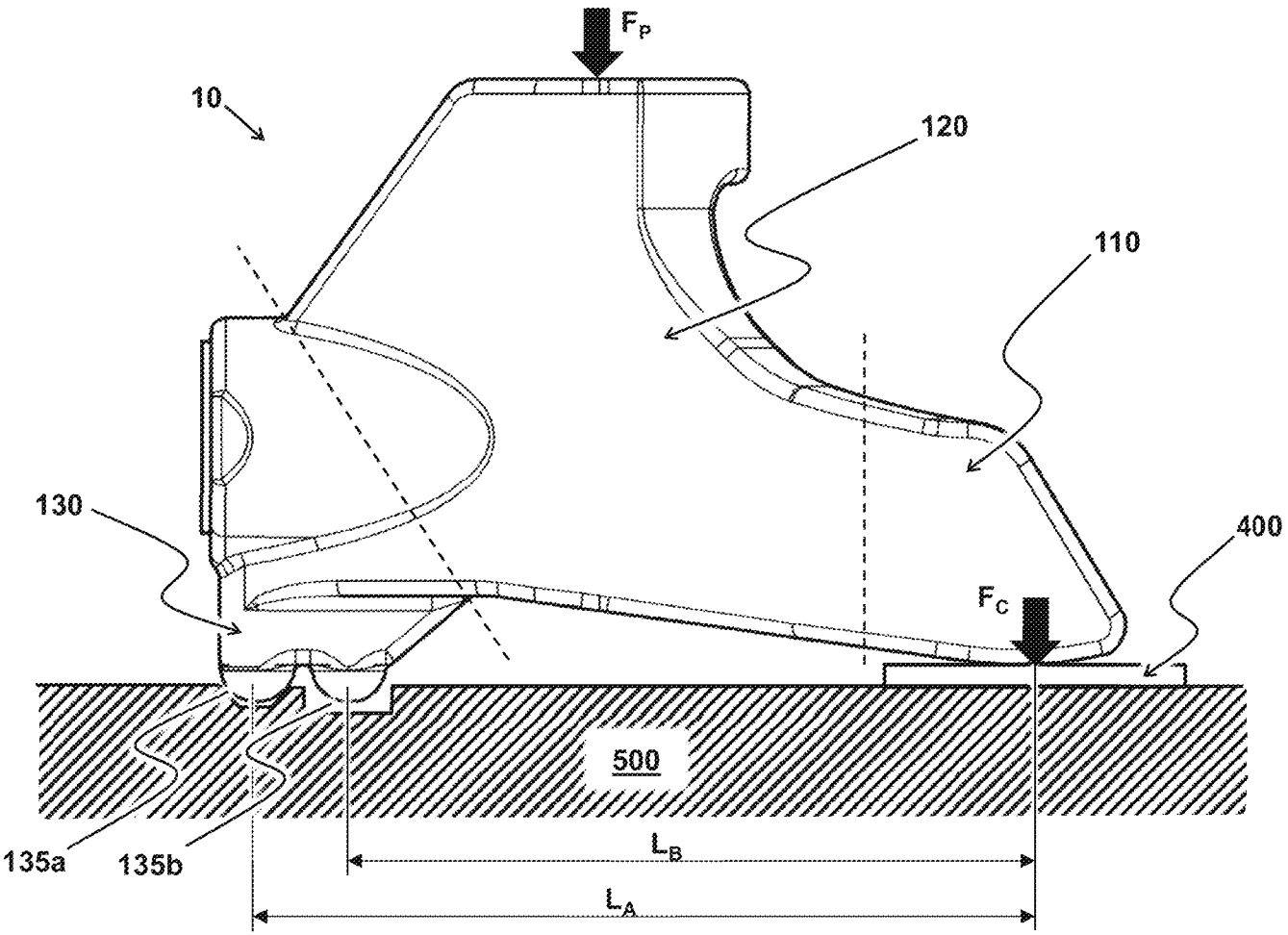
FIG. 1 illustrates a first embodiment of a bracket 10 for clamping an injector onto a cylinder head of an internal combustion engine.

Aspects of the invention relate to a bracket for clamping an injector onto a cylinder head of an internal combustion engine. The bracket comprises a clamp section arranged for providing a clamping force onto the injector to clamp the injector onto the cylinder head, a mount section extending from the clamp section and arranged for mounting the bracket to the cylinder head adjacent the injector, and a support section extending from the mount section opposite the clamp section and arranged for supporting the bracket onto the cylinder head at a lever distance from the clamp section, to define the clamping force. The support section comprises a plurality of support elements, with each of the support elements arranged at a different lever distance, such that a selected support element from the plurality of support elements engages, in use, with the cylinder head at a selected lever distance, so that the bracket is supported on the selected support element only, to control a magnitude of the clamping force.

In preferred embodiments, each support element of the plurality of support elements is arranged along a longitudinal axis extending between the support section and the clamp section, to simplify the design of bracket and to optimize the ratio of clamping capacity to weight of bracket.

Additionally, in some embodiments the mount section can comprise a hole, having a centerline perpendicular to the longitudinal axis for accommodating a preload bolt, such that, in use, the preload bolt engages with the cylinder head, to provide a preload downward force for generating the clamping force.

In yet further embodiments, the centerline intersects the longitudinal axis, to have the preload force provide a single lever action from a selected support element of the plurality of support elements to the clamp section.

Preferably, each support element of the plurality of support elements comprises a convex semi sphere, to provide a well-defined contact surface for engaging with the cylinder head.

In other or further preferred embodiments, each support element of the plurality of support elements is equal in size, to facilitate preparation of the cylinder head.

In some embodiments, the clamp section comprises a plurality of branches, each branch of the plurality of branches arranged for providing at least part of the clamping force onto the injector, to distribute the clamping force onto the injector.

The invention is described more fully hereinafter with reference to the accompanying drawings, in which embodiments of the invention are shown. In the drawings, the absolute and relative sizes of systems, components, layers, and regions may be exaggerated for clarity. Embodiments may be described with reference to schematic and/or cross-section illustrations of possibly idealized embodiments and intermediate structures of the invention. In the description and drawings, like numbers refer to like elements throughout. Relative terms as well as derivatives thereof should be construed to refer to the orientation as then described or as shown in the drawing under discussion. These relative terms are for convenience of description and do not require that the system be constructed or operated in a particular orientation unless stated otherwise.

Now turning to FIG. 1, there is illustrated a bracket 10 for clamping an injector 400 onto a cylinder head 500 of an internal combustion engine according to a first embodiment. Bracket 10 comprises a clamp section 110, a mount section 120, and a support section 130. Clamp section 110 is arranged for providing a clamping force $F_C$ onto injector 400 to clamp injector 400 onto cylinder head 500. Mount section 120 extends from clamp section 110 and is arranged for mounting bracket 10 to cylinder head 500 adjacent injector 400, e.g. by a preload force $F_P$. Support section 130 extends from mount section 120 opposite clamp section 110 and is arranged for supporting bracket 10 onto cylinder head 500 at a lever distance from clamp section 110, to define the clamping force $F_C$. In the embodiment, the lever distance is thus determined by a distance between a clamping position, i.e. a central position where the clamping force is transmitted to the injector 400, and a supporting position, i.e. a centerline of any of a supporting element 135*a* or 135*b*, whichever is actually supported on the cylinder head 500. For example, a preload force $F_P$ applied on mount section 120 when mounting bracket 10 to cylinder head 500 results, by lever action defined by lever distance $L_{A,B}$, in a clamping force $F_C$ between clamp section 110 and injector 400. As shown in FIG. 1, support section 130 comprises a plurality of support elements 135*a,b*. Each of support elements 135*a,b* is arranged at a different lever distance $L_{A,B}$ from clamp section 110. For example, the lever distance $L_A$ between support element 135*a* and clamp section 110 is larger than the lever distance $L_B$ between support element 135*b* and clamp section 110. FIG. 1 shows that selected support element 135*a* from the plurality of support elements 135*a,b* engages, in use, with cylinder head 500 at selected lever distance $L_A$, such that bracket 10 is supported on selected support element 135*a* only. For example, cylinder head 500 may comprise a centering hole to align with selected support element 135*a*, while material is removed from cylinder head 500 around non-selected support element 135*b*, such that bracket 10 is supported on selected support element 135*a* only. By having a bracket 10 comprising a plurality of support elements at different lever distances from clamp section 110, a selected support element can be arranged to engage, in use, with the cylinder head at a selected lever distance, to control a magnitude of the clamping force $F_C$ without changing the design or specification of the bracket and without changing the magnitude of the preload force $F_P$. For example, by selecting a different support element, such as support element 135*b* instead of support element 135*a* in FIG. 1, the magnitude of the clamping force $F_C$ can be reduced, due to the relatively shorter lever distance $L_B$ between selected support element 135*b* and clamp section 110. Although not depicted in FIG. 1, the lever distance is typically dependent on the central mount section, typically a center bolt, which provides a downward clamping force $F_P$, which is transmitted, through the lever distance to a clamping force $F_C$.

In some embodiments, for example as shown in FIG. 1, each support element 135*a,b* of the plurality of support elements comprises a convex semi sphere, to provide a well-defined contact surface for engaging with cylinder head 500. A convex spherical contact surface can for example engage with a centering hole in cylinder head 500, such that bracket 10 is aligned and pivotably supported on cylinder head 500. Alternatively, each support element 135 of the plurality of support elements may comprise a different shape protruding from support section 130, such as an end or a side of a cylinder, cone, or cuboid, such that each support element provides e.g. a flat, curved or double curved contact surface between support section 110 and cylinder head 500.

Preferably, each support element 135*a,b* of the plurality of support elements is equal in size, e.g. having an equal spherical diameter, or support width, or an equal length of protrusion from support section 130, to facilitate preparation of cylinder head 500, such that bracket 10 is supported on a selected support element only. Alternatively, support elements of the plurality of support elements 135*a,b* can have a different size relative to each other, e.g. differing in diameter, width, or length of protrusion from support section 130, to match a surface of cylinder head 500.

Figure 2:
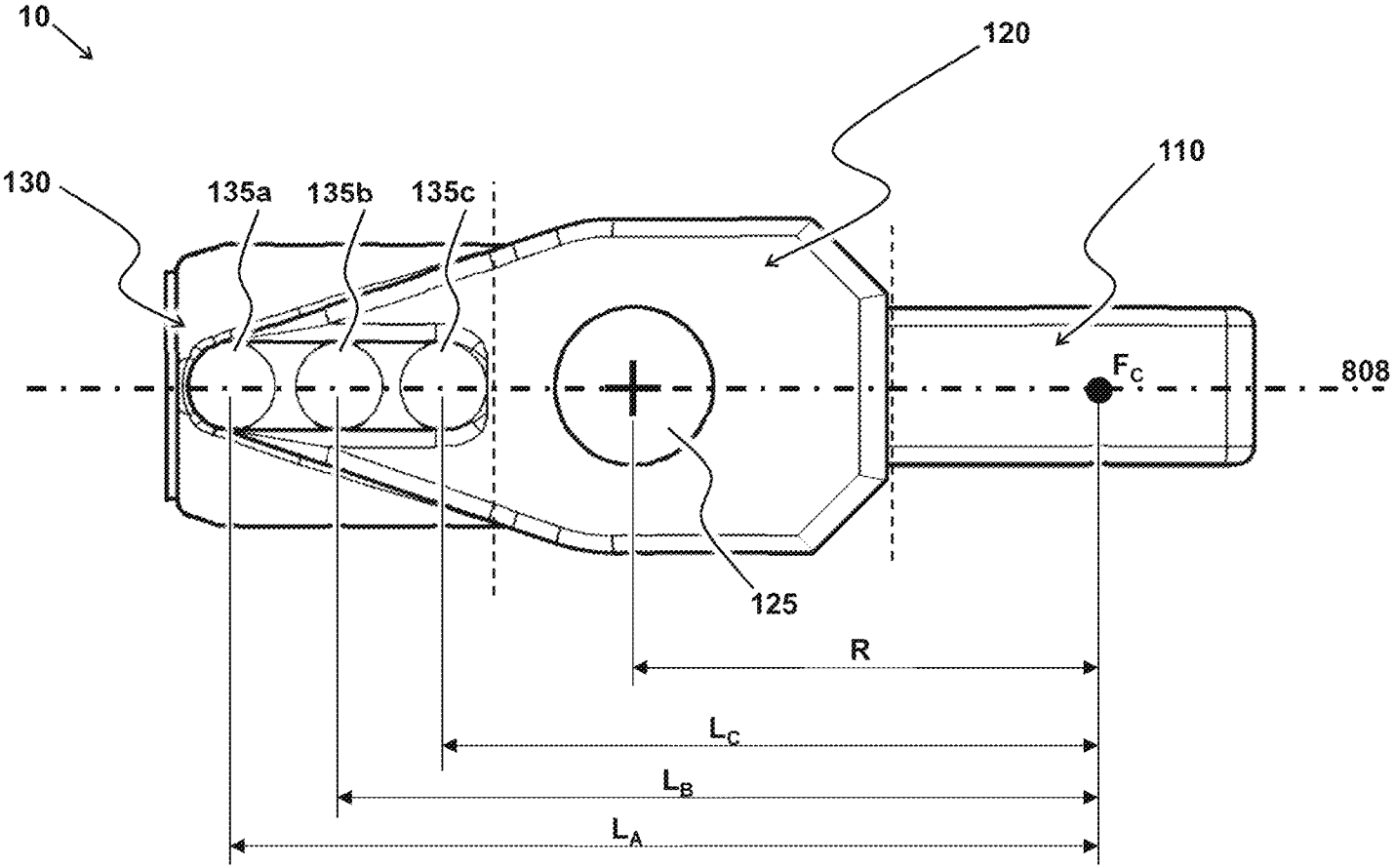
FIG. 2 provides a bottom view of another or further embodiment of the bracket 10.

FIG. 2 provides a bottom view of another or further embodiment of bracket 10. Each support element 135*a,b,c* of the plurality of support elements is arranged along a single longitudinal axis 808 extending between support section 130 and clamp section 110. As shown in FIG. 2, support element 135*a* is arranged on longitudinal axis 808 at lever distance $L_A$ from clamp section 110, support element 135*b* is arranged on longitudinal axis 808 at lever distance $L_B$ from clamp section 110, and support element 135*c* is arranged on longitudinal axis 808 at lever distance $L_C$ from clamp section 110. Lever distances $L_{A,B,C}$ can be defined as the distance along longitudinal axis 808, from the location of clamp force $F_C$ on clamp section 110 to support elements 135*a,b*, respectively.

By having each support element 135*a,b,c* of the plurality of support elements arranged along a single longitudinal axis 808 extending between support section 130 and clamp section 110, the design of bracket 10 can be simplified and the ratio of clamping capacity to weight of bracket 10 can be optimized. Preferably, longitudinal axis 808 is on a plane of symmetry of bracket 10, to further simplify and optimize the design of bracket 10. Alternatively, longitudinal axis 808 can be at an offset from the plane of symmetry of bracket 10.

Additionally, in some embodiments mount section 120 comprises a center hole 125, having a centerline perpendicular to longitudinal axis 808 for accommodating a preload center bolt, such that, in use, the preload bolt engages with cylinder head 500 to provide a preload downward force $F_P$ for generating the clamping force $F_C$. The preload bolt can e.g. be used for mounting bracket 10 to cylinder head 500 and for providing the preload force $F_P$ as shown in FIG. 1.

Figure 3:
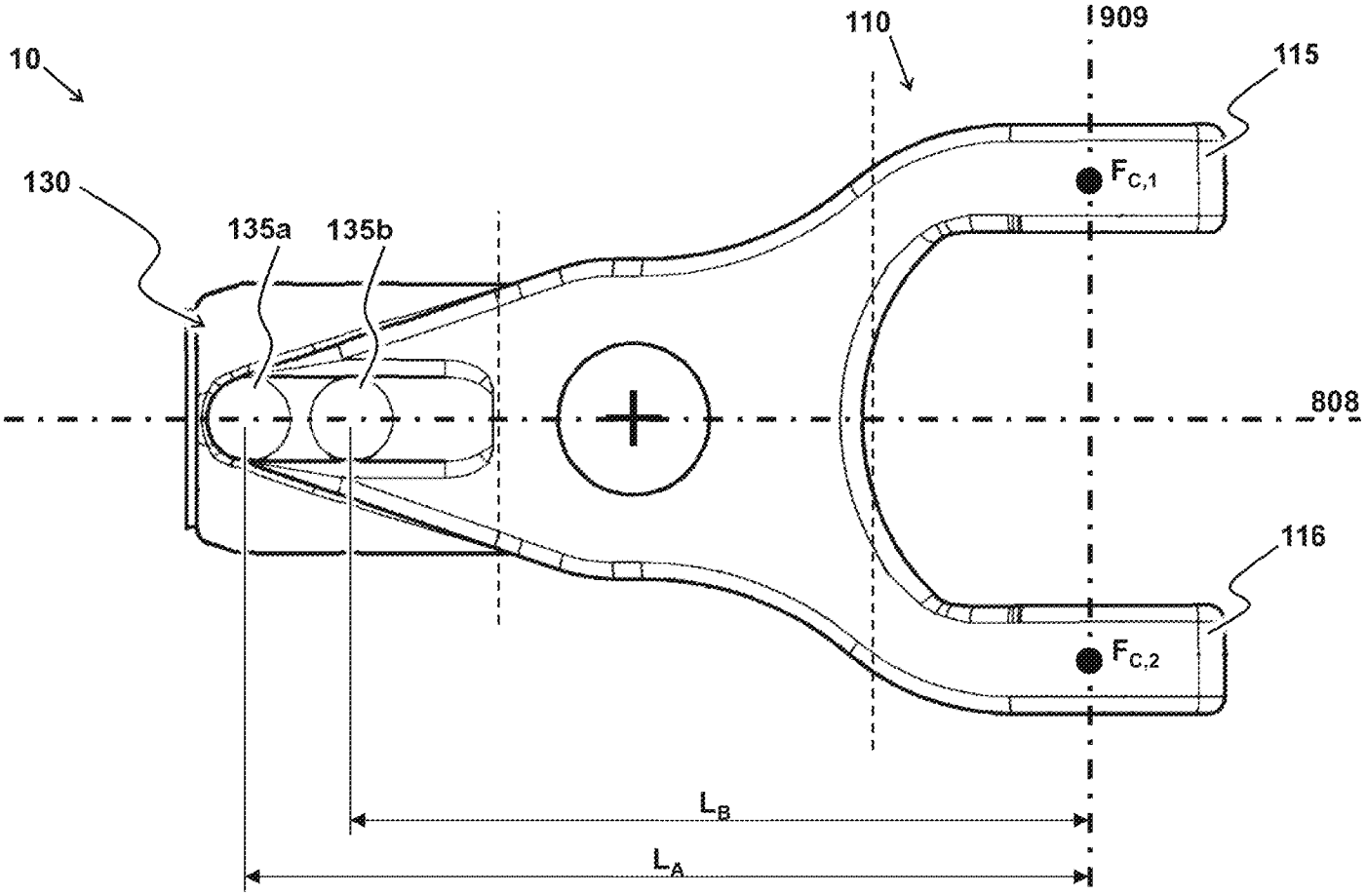
FIG. 3 provides a bottom view of yet another or further embodiment of the bracket 10.

In preferred embodiments, the centerline of hole 125 intersects longitudinal axis 808, e.g. at a fixed distance R from the clamping force $F_C$ on clamp section 110, such that the preload force $F_P$ provides a single lever action from a selected support element of the plurality of support elements 135*a,b,c*, to the clamp section 110, without providing a secondary, e.g. lateral, lever action on bracket 10. FIG. 3 shows yet another or further embodiment of the bracket 10, in a bottom view. Here, clamp section 110 comprises a plurality of branches, e.g. two branches 115, 116, each branch 115, 116 arranged for providing at least part of the clamping force $F_C$ onto injector 400. For example, the total clamping force $F_C$ can be divided between the plurality of branches 115, 116 by a first part of the clamping force $F_{C,1}$ on branch 115 and a second part of the clamping force $F_{C,2}$ on branch 116. Alternatively, bracket 10 may for example comprise branches that do not contribute to providing a clamping force onto injector 400, but instead are designed e.g. for holding a cable or for alignment of bracket 10, injector 400, or other components.

As shown in FIG. 3, the clamping force $F_{C,1}$, $F_{C,2}$ on branches 115, 116, respectively, is provided on a lateral axis 909 perpendicular to the longitudinal axis 808 extending between support section 130 and clamp section 110. Accordingly, the lever distances $L_{A,B}$ can be defined as the distance along longitudinal axis 808, between a central clamping position on axis 909 and support elements 135*a,b*, respectively.

Figure 4:
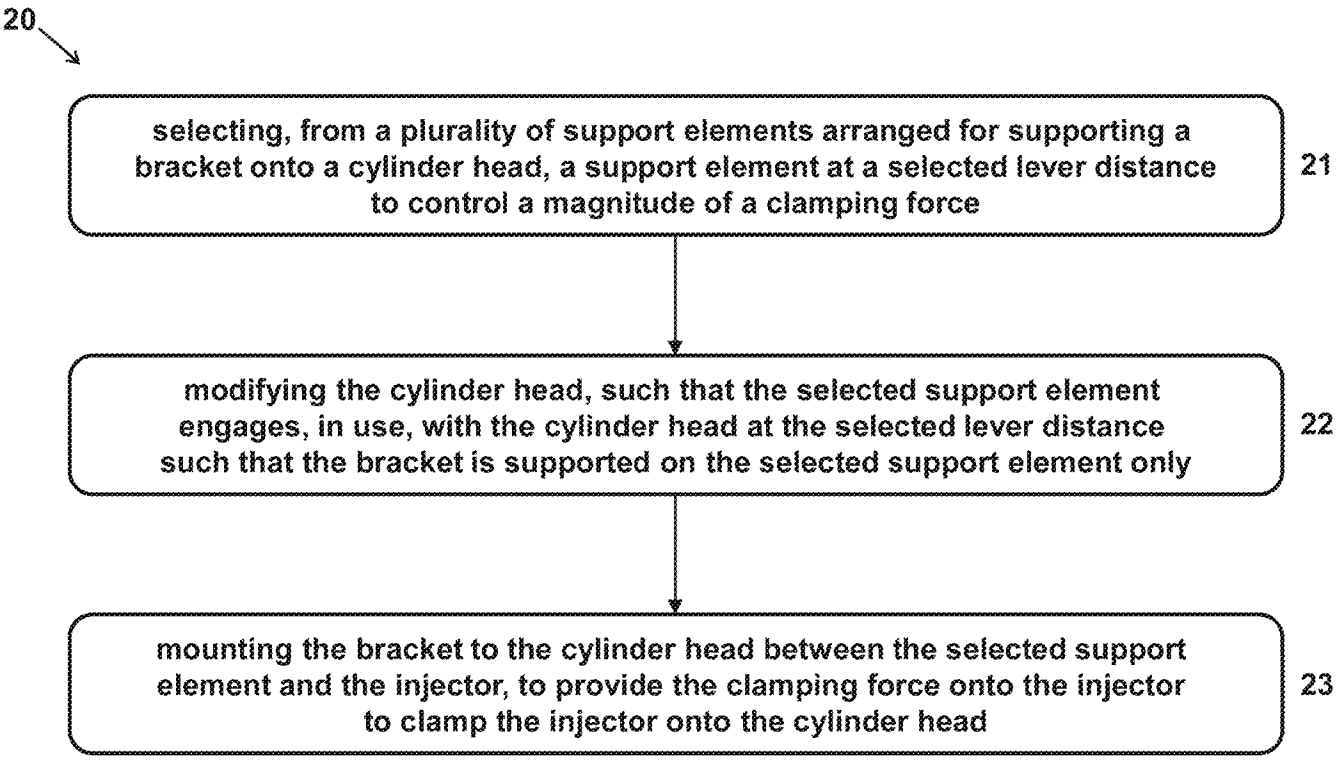
FIG. 4 provides a schematic overview of a method 20 of clamping an injector onto a cylinder head of an internal combustion engine by a bracket.

In FIG. 4, a schematic overview is provided of a method 20 of clamping an injector 400 onto a cylinder head 500 of an internal combustion engine by the bracket 10. The method 20 comprises, in a first step 21, selecting a support element 135 at a selected lever distance, from a plurality of support elements 135 arranged for supporting the bracket 10 onto the cylinder head 500 at different lever distances from a clamp section 110 of the bracket 10, to control a magnitude of a clamping force. In a second step 22, the method 20 comprises modifying the cylinder head 500, such that the selected support element 135 from the plurality of support element 135 engages, in use, with the cylinder head 500 at the selected lever distance such that the bracket 10 is supported on the selected support element 135 only.

Figure 5B:
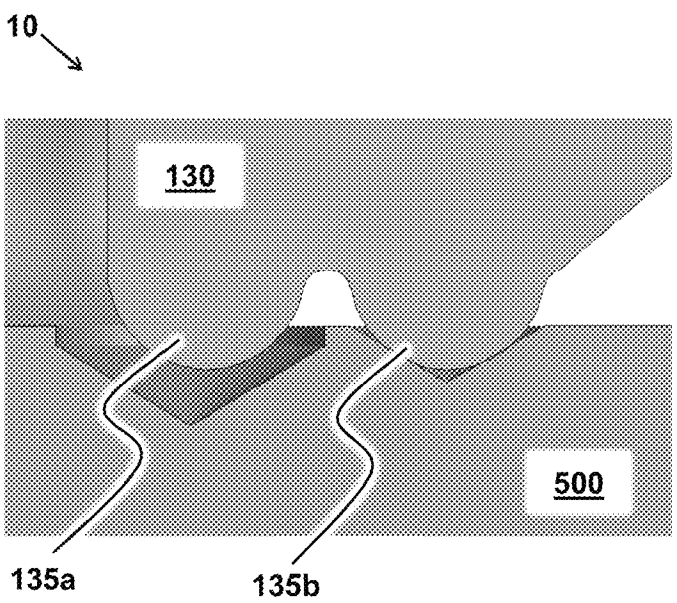
FIGS. 5A and 5B illustrate different results of the method 20.
Figure 5A:
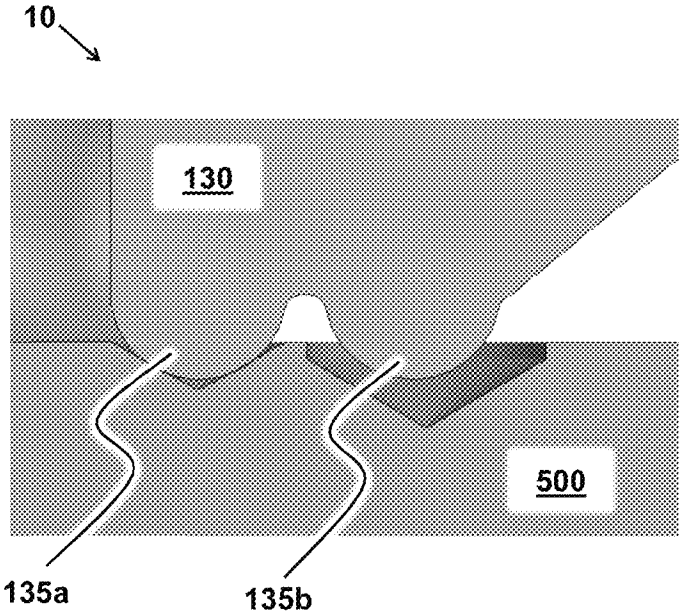

An example is given in FIGS. 5A and 5B. In FIG. 5A, cylinder head 500 is modified such that selected support element 135*a* from the plurality of support elements 135*a,b* engages, in use, with a centering hole in cylinder head 500 at the selected lever distance. Material around the non-selected support element 135*b* is removed from cylinder head 500, such that bracket 10 is supported on selected support element 135*a* only. Alternatively, in FIG. 5B, support element 135*b* is defined as the selected support element 135, and cylinder head 500 is modified such that selected support element 135*b* engages in use with a centering hole in cylinder head 500 at the corresponding selected lever distance, while material around non-selected support element 135*a* is removed from cylinder head 500, such that bracket 10 is supported on selected support element 135*b* only.

Back to FIG. 4, in a third step 23 of the method 20, the bracket 10 is mounted to the cylinder head 10 between the selected support element 135 and the injector 400, to provide the clamping force onto the injector 400 to clamp the injector 400 onto the cylinder head 500.

In this way, the same bracket design and specification can be used on different engines and/or injectors spread over different projects, instead of requiring a new design and/or specification when a change of bracket would normally be required, thereby providing a cost advantage. Besides that, by modifying the cylinder head, the clamping force can be controlled with the same bracket in an easier, more cost efficient and less time consuming way, because of improved manufacturing, assembly, maintenance, and quality and inspection processes.

The invention claimed is:

1. A bracket for clamping an injector onto a cylinder head of an internal combustion engine, comprising:

a clamp section, arranged for providing a clamping force onto the injector to clamp the injector onto the cylinder head;

a mount section, extending from the clamp section and arranged for mounting the bracket to the cylinder head adjacent the injector; and a support section, extending from the mount section opposite the clamp section and arranged for supporting the bracket onto the cylinder head at a lever distance from the clamp section, to define the clamping force;

wherein the support section comprises a plurality of support elements, each of said support elements arranged at a different lever distance, such that a selected support element from the plurality of support elements engages, in use, with the cylinder head at a selected lever distance, such that the bracket is supported on the selected support element only, to control a magnitude of the clamping force.

2. The bracket according to claim 1, wherein each support element of the plurality of support elements is arranged along a longitudinal axis extending between the support section and the clamp section.

3. The bracket according to claim 2, wherein the mount section comprises a hole, having a centerline perpendicular to the longitudinal axis for accommodating a preload bolt, such that, in use, the preload bolt engages with the cylinder head.

4. The bracket according to claim 3, wherein the centerline intersects the longitudinal axis.

5. The bracket according claim 1, wherein each support element of the plurality of support elements comprises a convex semi sphere.

6. The bracket according to claim 1, wherein each support element of the plurality of support elements is equal in size.

7. The bracket according to claim 1, wherein the clamp section comprises a plurality of branches, each branch of the plurality of branches arranged for providing at least part of the clamping force onto the injector.

8. A method of clamping an injector onto a cylinder head of an internal combustion engine by the bracket according to claim 1, comprising:

selecting, from a plurality of support elements arranged for supporting the bracket onto the cylinder head at different lever distances from a clamp section of the bracket, a support element at a selected lever distance to control a magnitude of a clamping force;

modifying the cylinder head, such that the selected support element from the plurality of support element engages, in use, with the cylinder head at the selected lever distance such that the bracket is supported on the selected support element only; and mounting the bracket to the cylinder head between the selected support element and the injector, to provide the clamping force onto the injector to clamp the injector onto the cylinder head.

9. The method according to claim 8, where the brackets are mounted to the cylinder head with a preload mounting force that is the same irrespective of a selected support element.

* * * * *